US005896988A

United States Patent [19]

De Jong

[11] Patent Number: 5,896,988

[45] Date of Patent: Apr. 27, 1999

[54] WRAPPER FOR A BUNCH OF FLOWERS

[76] Inventor: Nicolaas Arie De Jong, Maasdijk 176, NL-2676 LC Maasdijk, Netherlands

[21] Appl. No.: 08/973,118

[22] PCT Filed: Jun. 6, 1996

[86] PCT No.: PCT/NL96/00226

§ 371 Date: Dec. 5, 1997

§ 102(e) Date: Dec. 5, 1997

[87] PCT Pub. No.: WO96/39346

PCT Pub. Date: Dec. 12, 1996

[30] Foreign Application Priority Data

Jun. 6, 1995 [NL] Netherlands ..... 1000500

[51] Int. Cl.[6] ..... B65D 85/50

[52] U.S. Cl. ..... 206/423; 229/87.01; 47/30; 47/66.6

[58] Field of Search ..... 206/423; 229/87.01, 229/87.03; 47/30, 31, 65.7, 65.8, 66.6, 47

[56] References Cited

U.S. PATENT DOCUMENTS

| | | | |
|---|---|---|---|
| 376,699 | 4/1888 | Meyer | 161/27 |
| 1,446,563 | 2/1923 | Hughes | 206/423 |
| 3,376,666 | 4/1968 | Leonard . | |
| 4,250,664 | 2/1981 | Remke | 206/423 |
| 4,801,014 | 1/1989 | Meadows . | |
| 5,222,603 | 6/1993 | Ma | 206/423 |

FOREIGN PATENT DOCUMENTS

| | | |
|---|---|---|
| 2 286 759 | 4/1976 | France . |
| 93 09 134.6 | 8/1993 | Germany . |
| 8 802 054 | 3/1990 | Netherlands . |

*Primary Examiner*—Paul T. Sewell
*Assistant Examiner*—Nhan T. Lam
*Attorney, Agent, or Firm*—Young & Thompson

[57] ABSTRACT

A holder for a bunch of flowers includes a sleeve surrounding the bunch, which is designed as a truncated cone having circumferential reinforcements at the free openings to form a relatively rigid form and a trying cord fastened to the sleeve lower free opening.

7 Claims, 2 Drawing Sheets

WRAPPER FOR A BUNCH OF FLOWERS

BACKGROUND OF THE INVENTION

The present invention relates to a flower holder.

DESCRIPTION OF THE RELATED ART

A holder of this kind is known from NL-A-8802054. It should be understood that where reference is made in this description to bottom opening or other parts with bottom or top, a state of the holder in which the flowers of a bouquet are situated at the top side and the stalks are situated at the inderside is intended. A bunch of flowers can, of course, also be positioned inversely.

Such a holder is used to receive a bunch of flowers. On the underside an opening remains free in order to be able to place the stalks of the flowers in a bucket or the like in order to provide supply of water.

Although packaging of this kind is quite adequate it has the disadvantage that the position of the bunch of flowers with regard to the holder is not fixed so that it is quite possible that the flowers will leave the holder in an uncontrolled way.

SUMMARY OF THE INVENTION

The invention aims to remove this drawback. This object is achieved in the case of a holder as described above by means of the characterizing features of claim 1.

As a result, the arrangement of a bouquet is preserved and damage to the plants is prevented. Moreover, due to the presence of a tying cord, the bouquet can easily be secured.

The above-described circumferentical reinforcement may be present not only on the underside but also on the top side. Moreover, further circumferential reinforcements may be present.

Although the sleeve may have all forms known in the prior art, it is preferably designed as a truncated cone.

The sleeve may be made from all materials known in the prior art. In a preferred embodiment, the structure comprises strip parts which extend perpendicularly to the above-described circumferential reinforcement.

These strip parts, as well as the rest of the sleeve, can be made from reed-like material.

It is, however, also quite possible to construct the sleeve in a different manner. Thus it can consist of a lattice, such as gauze. With a construction of this kind, at least part of what is situated inside the sleeve remains visible, which can be attractive for certain applications.

The above-described holder can also be used in combination with pot plants. If the underside of the pots is, provided with openings, it is often undesirable for moisture to escape to the outside through these openings. In such a case, it is proposed to arrange a sheet of plastic material or other liquid-tight material in the vicinity of the opening of the holder, and such a sheet provides a liquid-tight seal at the bottom when the pot plant is placed through the opening.

BRIEF DESCRIPTION OF THE DRAWINGS

The invention will be illustrated in more detail below with reference to an exemplary embodiment depicted in the drawing, in which.

DESCRIPTION OF THE PREFERRED EMBODIMENT

Figure 1:
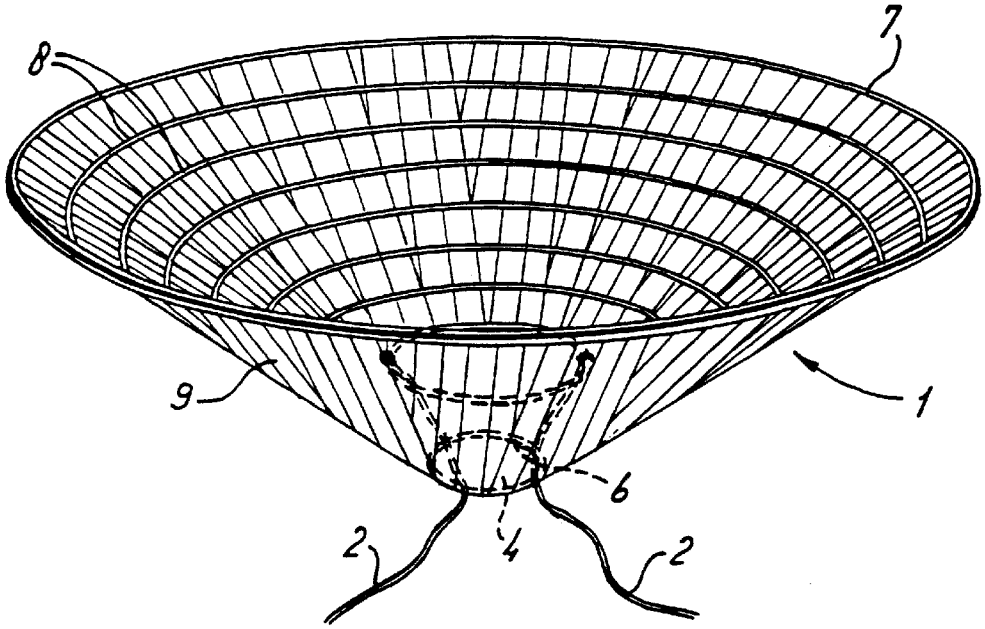
FIG. 1 shows a perspective and cut-away view of the holder according to the invention.
Figure 2:
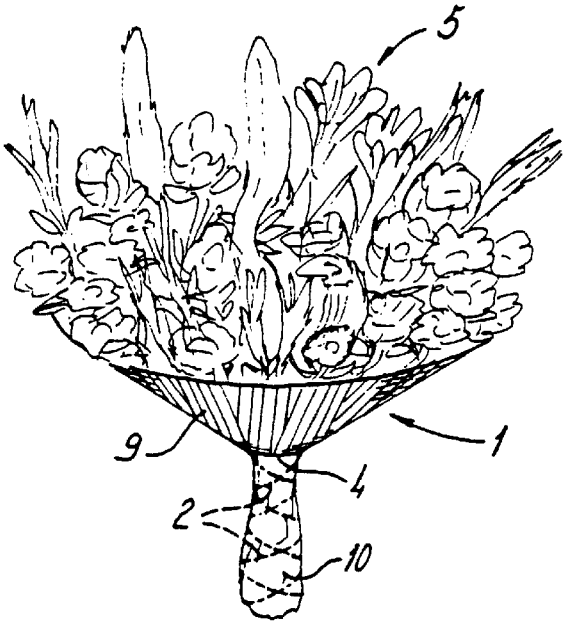
FIG. 2 shows the holder according to the invention with a number of flowers arranged therein.

The sleeve according to the invention is indicated in its entirety by 1 in FIGS. 1 and 2. This sleeve consists of a number of reinforcement ribs 6–8 which extend along the circumference of the sleeve 1. In this case, reinforcement rib 6 is situated in the vicinity of the bottom opening 4, reinforcement rib 7 in the vicinity of the top opening and reinforcement rib 8 between them. These reinforcement ribs are supported by strip parts 9. Tying cords 2 are fastened to the bottom reinforcement ribs 6.

All the said components can be made from a reed-like material. Conventional joining techniques, such as sewing, can be used to hold the various parts together.

Instead of the relatively fine structure shown here, it is also possible to use a coarse structure.

In FIG. 2, the use of the sleeve according to the invention in combination with a bunch of flowers 5 is shown. It can be seen from this that stalks of the bunch project through the bottom, smaller opening 4, which stalks are held together by the tying threads 2. For protection, a further sleeve 10 may optionally be placed over the stalks, or a piece of aluminium foil may be used.

With the structure chosen here, the bouquet which is present in the sleeve will not easily be changed to a different arrangement. Moreover, the reinforcement ribs 6-8 provide protection against external forces. The bouquet according to the present invention will also not be flattened during transportation and optimum presentation is obtained.

Figure 3:
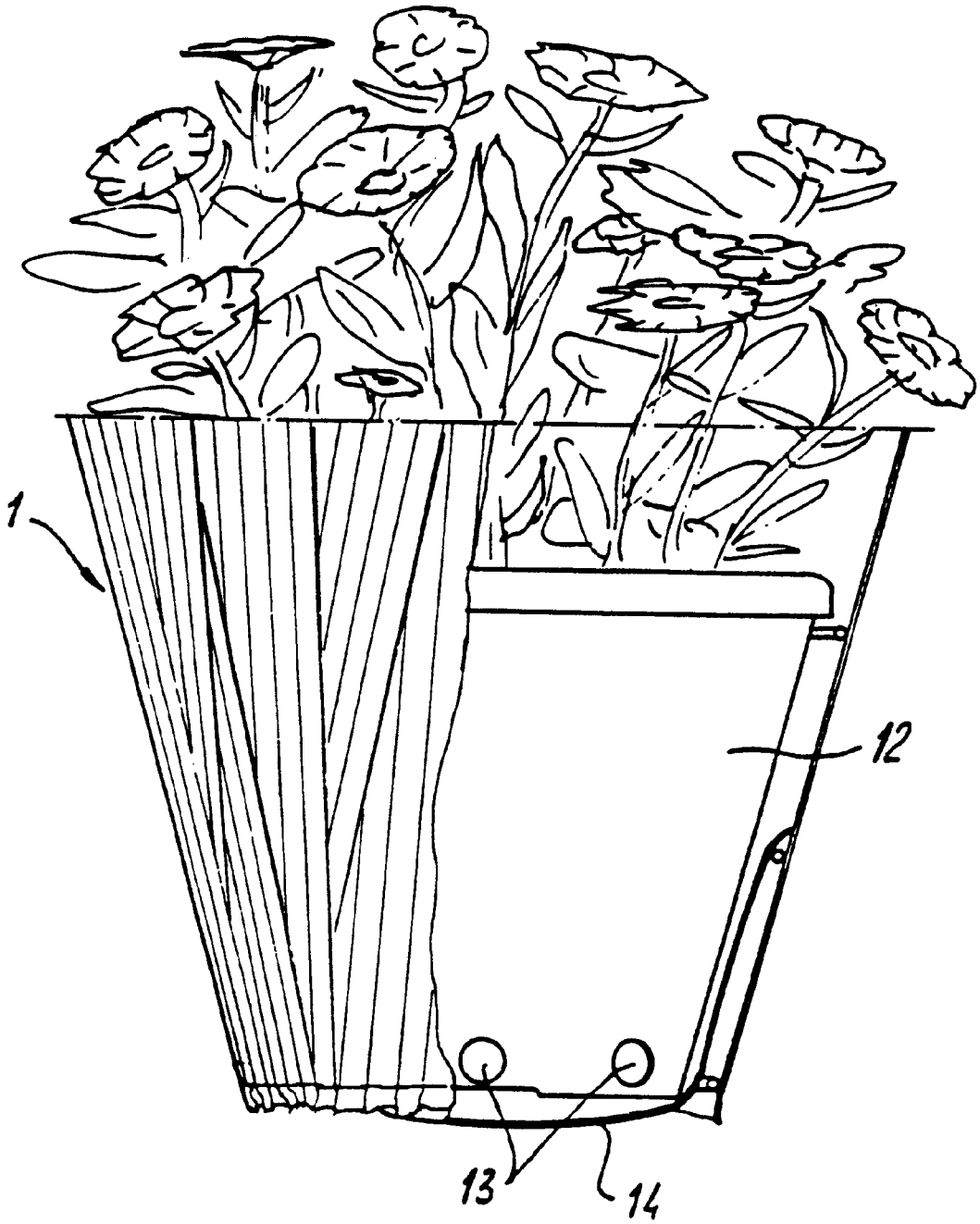
FIG. 3 shows the holder according to the invention in combination with a pot plant.

In FIG. 3, a further embodiment of the holder according to the invention in combination with a pot plant is shown.

Parts which correspond to FIGS. 1 and 2 are provided with the same reference numerals. The tying threads 2 are used here to secure the pot plant to the sleeve 1.

The pot of the pot plant is indicated by 12 and is provided with an opening 13.

In order to prevent moisture from leaking through this opening 13, it is proposed to arrange a sheet of material 14 in the holder according to the invention. When the opening 4 arranged on the underside of the sleeve 1 is spread open, the sheet 14 will provide a lower boundary for the structure. This sheet 14 remains invisible to the user due to the presence of the reed-like material.

Although the invention is described above with reference to a preferred embodiment, it should be understood that numerous modifications may be made thereto without departing from the scope of the present application. Thus it is possible to produce the structure from gauze material, which may or may not be provided with a curing resin. The opening in the holder may also be present in a prepared state, that is to say due to the absence of threads extending around the top of the cone. It is also possible to use a different polygonal shape instead of a truncated cone shape. This and similar variants are all considered to be obvious and to lie within the scope of the claims.

I claim:

1. A holder for a bunch of flowers comprising:

a sleeve having an upper opening, a lower opening, an interior surface designed to surround the flowers and an exterior surface;

a plurality of strips running generally from said lower opening to said upper opening;

a plurality of circumferential reinforcements supported by said plural strips;

a first of said plural circumferential reinforcements being located at said lower opening; and a tying cord attached to one of said plural circumferential reinforcements and having a length to allow said tying cord to extend through said lower opening.

2. The holder of claim 1, wherein a second of said plural circumferential reinforcements is located at said upper opening.

3. The holder of claim 1, wherein said sleeve is in the shape of a truncated cone.

4. The holder of claim 1, wherein one of said plural strips is aligned perpendicularly to said plural circumferential reinforcements.

5. The holder of claim 1, wherein said plural strips comprise a reed material.

6. The holder of claim 1, wherein said sleeve further comprises a lattice.

7. The holder of claim 6, wherein said lattice comprises a gauze.

* * * * *